United States Patent [19]

Barecki

[11] 3,948,557

[45] Apr. 6, 1976

[54] FASTENING SYSTEM FOR REMOVABLE SEAT INSERT

[75] Inventor: Chester J. Barecki, Grand Rapids, Mich.

[73] Assignee: American Seating Company, Grand Rapids, Mich.

[22] Filed: Apr. 21, 1975

[21] Appl. No.: 569,975

[52] U.S. Cl. ..... 297/283; 297/452

[51] Int. Cl.[2] ..... A47C 27/00

[58] Field of Search ..... 5/280; 52/511; 297/218, 297/219, 223, 283, 440, 444, 450, 452, 218.2; 292/259, 304

[56] References Cited

UNITED STATES PATENTS

| | | | |
|---|---|---|---|
| 565,231 | 8/1896 | Bing | 297/452 |
| 3,663,057 | 5/1972 | Lohr et al. | 297/452 X |
| 3,797,887 | 3/1974 | Barecki | 297/450 X |

*Primary Examiner*—James C. Mitchell

*Attorney, Agent, or Firm*—Price, Heneveld, Huizenga & Cooper

[57] ABSTRACT

A removable insert for a transit chair shell has a plurality of studs protruding from the back of the insert. A plurality of openings in the chair shell receive the studs. A removable restraining means prevents withdrawal of the studs thereby securely positioning the insert to the chair shell. The restraining means is arranged to be moved and the insert removed without disassembly of the chair from its operational configuration.

12 Claims, 8 Drawing Figures

FASTENING SYSTEM FOR REMOVABLE SEAT INSERT

BACKGROUND

The present invention relates to a transit seat which is particularly suited for use in a mass transportation vehicle, such as a bus or a rapid transit train.

Plastic shells have been used in transit seats, the principal advantages being in lower costs of maintenance and manufacturing. Also, inserts for plastic shells are known. Examples of such inserts are described in U.S. Pat. Nos. 3,737,198 and 3,797,887. The inserts may be padded for additional comfort so as to provide a somewhat more luxurious seat than a conventional plastic shell while maintaining the basic qualities of durability, economy, and ease of maintenance inherent in the plastic seats. The inserts further provide the ability to design a desired color scheme into the seat. In the event of vandalism to the inserts, which cover the largest exposed portion of the seat, an individual insert which is damaged must be removed and replaced.

The prior art teaches using several screws to secure the inserts to the plastic shell. Accordingly, to replace an insert the screws must be removed and replaced. Furthermore, the seat typically has a back cover secured by a plurality of screws which must be removed to obtain access to the screws holding in the insert. After the insert is replaced the back cover must again be secured by screws. A typical back cover for a two passenger seat has a number of screws exceeding ten. Thus, to remove one insert, a plurality of screws must be unscrewed and rescrewed. Further, the screws holding the back cover are typically self-threading and hold less tightly with successive rescrewings into the same hole. As a result, removal of an insert presents the possibility of loss of screws and replacement of the insert and back cover with less than a full complement of screws. Replacement time is obviously related to labor costs and time out-of-service for the bus.

It has been desirable to provide a fastening means for inserts for plastic shells which provides for correct replacement of the inserts while reducing labor costs and time out-of-service for the bus. Furthermore, it has been desirable to be able to use such a fastening means whenever replacement of inserts is desired because of wear, vandalism, a desire to change color schemes or some other reason.

SUMMARY

The invention provides for removal of an insert without removing the back cover or any screws. In accordance with an embodiment of this invention, studs protrude from the back of the insert and engage openings in a plastic shell. A first set of openings can be of a key hole slot type wherein the first plurality of studs can be inserted into a larger portion and then slid to a narrower portion thereby restraining the stud. A second set of openings permit the second set of studs to pass through the plastic shell and be positively engaged by an insert restraining means.

In accordance with the preferred embodiment of this invention, the insert restraining means is a substantially rectangular bar which is rotationally secured to the plastic shell and has notches for engaging the second studs and prevents their withdrawal through the second set of openings in the plastic shell. One end of the bar is engaged with a portion of the chair to retard rotation of the insert restraining bar thereby positively coupling the insert to the plastic shell. Further, in accordance with an embodiment of this invention, the back cover of the chair has an opening through which a tool can be inserted to engage an opening in the bar and to rotate the bar. Since the back cover need not be removed, it can be riveted, instead of screwed, into place. Screws are not lost and correct securing of the insert is quickly accomplished. A firmly fastened back cover is desirable to shield a passenger from any insert fastening means. Further, the invention requires a low level of skill for replacing inserts and allows quick replacement thereby resulting in less out-of-service time for the bus and lower labor costs.

THE DRAWINGS

DETAILED DESCRIPTION

Figure 1:
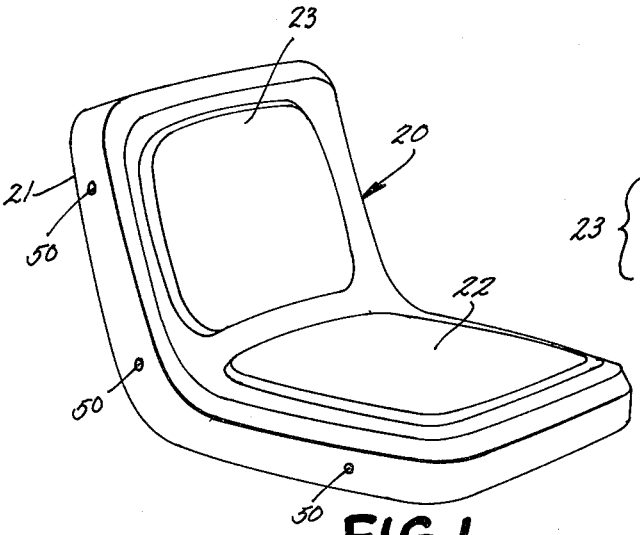
FIG. 1 is an upper frontal perspective view of a seat in accordance with this invention.

Referring to the drawings, the seat 20 includes a one-piece contoured plastic shell 21 mounted on a tubular steel or metal frame 26 by pop rivets 50. Mounted on shell 21 is the seat insert pad 22 and back insert pad 23. Covering the back of the shell is the back cover 90. Back cover 90 is attached to frame 26 by fastening means 97.

Figure 3:
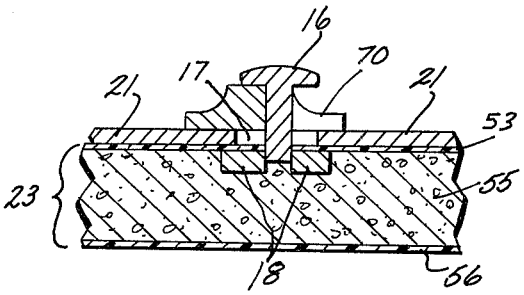
FIG. 3 is a cross-sectional view along section line III—III of FIG. 2.
Figure 8:
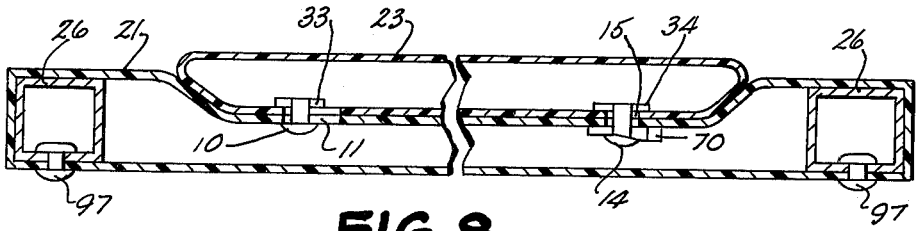
FIG. 8 is a cross-sectional view along section line VIII—VIII of FIG. 7.

As best shown in FIG. 3, back insert pad 23 includes a thin metal inner liner 53, a layer of foam material 55, and an upper upholstery panel 56. This insert could however be a molded plastic or any equivalent material. Back insert pad 23 also includes studs 10, 12, 14 and 16 protruding from the back of the insert and each having a head and a narrower body portion between the head and the back of the insert. These studs can be anchored to insert 23 by a weld nut attached to thin metal inner liner 53 or in the case of a plastic insert can be a T-nut in which is threaded a bolt. In FIG. 3, a weld nut 18, associated with stud 16, is shown in cross-section. In FIG. 8, weld nuts 33 and 34, associated with studs 10 and 14, respectively, are shown in cross-section.

Figure 2:
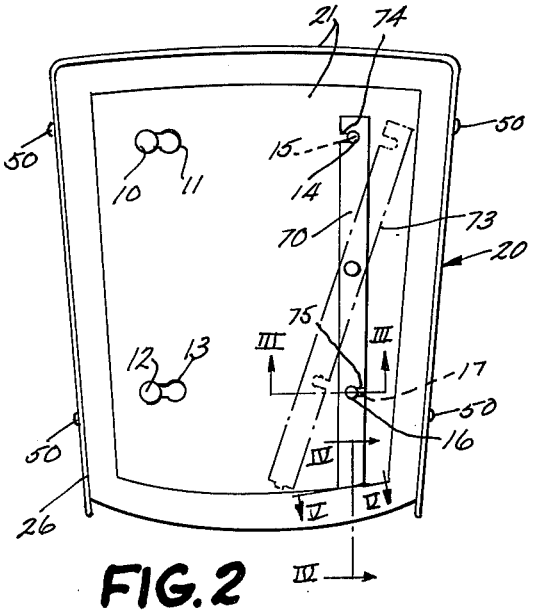
FIG. 2 is a rear elevation view of the interior of a seat in accordance with an embodiment of this invention.

As shown in FIG. 2, plastic shell 21 has an opening 11 aligned to receive stud 10, an opening 13 aligned to receive stud 12, an opening 15 (visible only in FIG. 8) aligned to receive stud 14 and an opening 17 (visible only in FIG. 3) aligned to receive stud 16. Openings 11 and 13 are key shaped. Studs 10 and 12 are inserted into receiving portions of openings 11 and 13 respectively and then slid over to a narrow portion of the opening. Once insert 23 is in this position, with studs 10 and 12 inserted, studs 14 and 16 are inserted into openings 15 and 17, respectively. Openings 15 and 17 are not slotted and restrain insert 23 from moving so that studs 10 and 12 could withdraw through openings 11 and 13, respectively.

To prevent studs 14 and 16 from withdrawing through their respective openings a retaining bar 70 is positioned around studs 14 and 16. Bar 70 is pivotally hinged to plastic shell 21 by pivot 71. To show rotation of bar 70, a dotted outline 73 of bar 70 is shown in an offset rotational position. Bar 70 has notches 74 and 75 to engage studs 14 and 16, respectively. It can be appreciated that the distance between insert 23 and the heads of studs 10 and 12 need only be enough to clear the thickness of plastic shell 21. However, the same dimension on studs 14 and 16 must be sufficient to clear the thickness of plastic shell 21 and the thickness of bar 70 when engaged with the studs.

A cross section of bar 70, stud 16 and insert 23 is shown in FIG. 3. As bar 70 is rotated into position it can be seen that the leading edge of bar 70 which is inclined acts as a wedge to positively draw insert 23 against plastic shell 21. The final thickness of bar 70, when it abuts stud 16, should be such so there is a tight fit between stud 16, bar 70, shell 21, and metal sheet 53 of insert 23.

Figure 4:
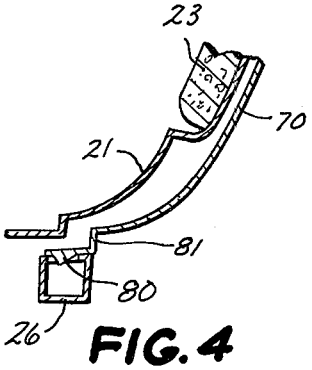
FIG. 4 is a cross-sectional view along section line IV—IV of FIG. 2.
Figure 5:
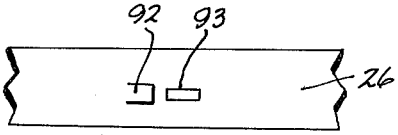
FIG. 5 is a cross-sectional view along section line V—V of FIG. 2.

To prevent rotation of bar 70, once studs 14 and 16 have been engaged, an end portion of bar 70 is used to engage a portion of frame 26. A cross-sectional view in FIG. 4 along section IV—IV of FIG. 2 shows how bar 70 curves along the curvature of shell 21 and reaches a portion of frame 26. A protrusion 80 from the end portion of bar 70 engages an opening 93 in frame 26 thereby positively preventing rotation. If desired, for added protection against inadvertent rotation, there can be a protrusion 92 (shown in FIG. 5) from frame 26 over which protrusion 80 must pass before it reaches opening 93 in frame 26. FIG. 5 shows the relative location of protrusion 92 and opening 93 engaged by protrusion 80. Bar 70 has an opening 81 accessible from the back and of a shape and size to just receive the end of a screw driver.

Figure 6:
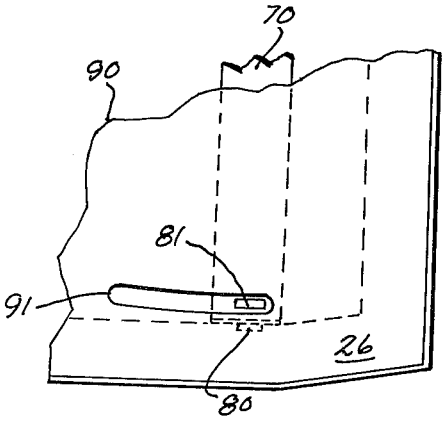
FIG. 6 is a partial view of the lower right portion of a back cover and seat in accordance with an embodiment of this invention.
Figure 7:
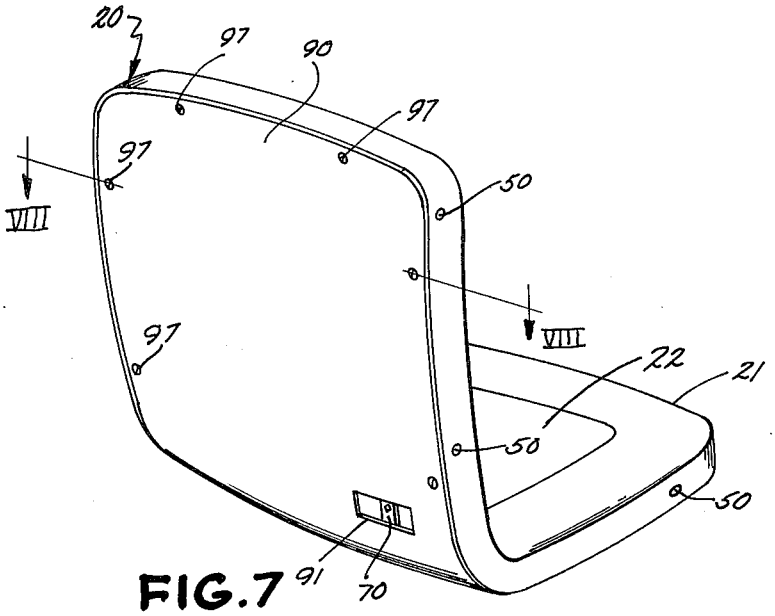
FIG. 7 is an upper rear perspective view of a seat in accordance with this invention.

As shown in FIG. 7, seat 20 has back cover 90 with an arcuate opening 91 aligned with a bottom portion of bar 70. FIG. 6 shows the lower right hand portion of back cover 90 and the alignment of opening 91 in back cover 90 with the rotational path of opening 81 in bar 70. A cross-sectional view in FIG. 8 along section VIII—VIII of FIG. 7 shows how insert 23 fits into a recess in shell 21, is fastened to shell 21 and how back cover 90 is fastened to frame 26 by fastening means 97.

OPERATION

An insert can be secured into place by relatively simple steps. Bar 70 is rotated so notches 74 and 75 are offset from openings 15 and 17, respectively. This can be done by inserting a tool such as a screwdriver through opening 91 in back 90 and engaging opening 81 in bar 70. Moving the screwdriver along arcuate opening 91 rotates bar 70. Studs 10 and 12, having a body length sufficient just to clear the thickness of shell 21, are inserted into openings 11 and 13, respectively. Insert 23 is slid so the narrow slot portions of openings 11 and 13 engage studs 10 and 13, respectively. Studs 14 and 16 are now aligned with openings 15 and 17, respectively, and are inserted through shell 21. With studs 14 and 16 protruding beyond the back of shell 21, the screwdriver is positioned in opening 81 to contact bar 70 and is moved along arcuate opening 91 until notches 74 and 75 engage studs 14 and 16, respectively. Once protrusions 81 from bar 70 engages opening 93 in frame 26 there is increased resistance to movement of bar 70 and the screwdriver can be removed.

Removing insert 23 is also a relatively simple process. A person must simply rotate bar 70 by overcoming the force that holds protrusion 80 into opening 93. This can be done by inserting a screwdriver through opening 91 and into opening 81 and then moving the screwdriver along arcuate opening 91. Of course, if desired such access to bar 70 can be from the bottom of the seat. After rotation of bar 70, studs 14 and 16 are retracted through openings 15 and 17, respectively. Insert pad 23 is then slid along the slots of openings 11 and 13 until studs 10 and 12 are aligned with the larger portions of openings 11 and 13, respectively. Withdrawal of studs 10 and 12 through their respective openings disengages insert 23 from shell 21.

Various modifications and variations will no doubt occur to those skilled in the various arts to which this invention pertains. For example, elongated fastening means extending from the insert may vary in shape from the studs as described. Also, the retaining bar may be movably mounted by means other than a centrally located pivot. Further, a seat insert pad can be secured to a seat as described. To remove or install a seat insert pad it is not necessary to remove a back or bottom cover. These and all other variations which basically rely on the teachings through which this disclosure has advanced the art are properly considered within the scope of this invention.

The embodiments of the invention in which an exclusive property or privilege is claimed are defined as follows:

1. A passenger seat for a mass transit vehicle comprising:
   - a frame;
   - a one-piece rigid shell mounted on the frame, and having interior boundaries defining mounting openings;
   - an insert having elongated fastening means, the insert mounted to the shell so the elongated fastening means extend through the mounting openings; and
   - an insert restraining means for securing at least some of the elongated fastening means to prevent movement of the elongated fastening means back through the mounting openings of the shell, the insert restraining means including a movable member which is movably mounted to the passenger seat, the movable member having a first position permitting insertion of the elongated fastening means through the mounting openings and a second position preventing the withdrawal of the elongated fastening means through the mounting openings.

2. A seat as recited in claim 1 wherein the elongated fastening means includes:
   - a first pair of studs having nail-like heads, the heads being spaced from the insert a distance equal to about the thickness of the shell, and having stud bodies between the heads and the insert, the bodies being narrower than the heads; and
   - a second pair of studs having nail-like heads, the heads being spaced from the insert a distance equal to about the combined thickness of the shell and the movable member of the insert restraining means, and having stud bodies between the heads and the insert, the bodies being narrower than the heads.

3. A seat as recited in claim 2 wherein the shell is plastic and includes:

a first pair of interior boundaries defining a first pair of openings positioned to be aligned with the first pair of studs, each opening having a receiving portion sufficiently large to pass the head of one of the first pair of studs and a connected slot portion, narrower than the head, for engaging the head; and a second pair of interior boundaries defining a second pair of openings, each opening having an entry portion sufficiently large to pass the head one of the second pair of studs, the second pair of openings being positioned to be aligned with the second pair of studs when the first pair of studs is engaged by the slot portions of the first pair of openings.

4. A seat as recited in claim 3 wherein the insert restraining means includes:

an elongated, flattened bar having a central portion rotationally secured to the shell, a pair of notches about the width of the body of a stud of the second pair, positioned so each notch can engage one of the second pair of studs, and an end portion of the bar for non-rotationally engaging a portion of the seat to latch the bar thereby restraining the insert.

5. A seat as recited in claim 4 wherein the end portion of the bar for non-rotationally engaging a portion of the seat comprises:

a protrusion extending from the bar for engaging the frame; and an interior boundary in the bar defining an opening in the bar so a tool inserted into the opening in the bar can be used to rotate the bar.

6. A seat as recited in claim 5 further comprising a back piece covering the back of the shell and secured to the frame, the back piece having an opening aligned with the opening in the bar, the opening in the back piece extending along an arc described by the opening in the bar as the bar rotates, and large enough to pass an instrument for engaging the hole in the bar and causing rotation of the bar so the notches in the bar clear the second pair of studs.

7. In a seat having a frame, a one piece rigid plastic shell mounted on the frame, an insert fastened to the shell, and a back cover attached to the frame the improvement comprising:

fastening means for fastening the insert to the shell including studs, with nail-like heads, protruding from the back of the insert, interior boundaries of the shell defining openings through the shell aligned with the studs, each opening having a portion large enough to receive the head of the stud and at least one opening having a narrower slot to engage the head;

an insert retainer having a generally rectangular shape, rotationally connected to the shell at a central pivot point, at least one notched portion for engaging a stud, and an end portion for engaging the frame to prevent rotation when a stud is engaged and for providing connection means to the insert retainer to provide controlled rotation;

an interior boundary of the frame defining an opening for receiving the end portion; and an interior boundary of the back cover defining an opening for passing an instrument to connect to the connection means of the insert retainer, the opening extending along an arc described by the end portion of the insert retainer as the insert retainer rotates.

8. A seat comprising:

a plastic shell having a first keyhole mounting opening having a receiving portion and a connected, narrower slot portion and a second mounting opening;

an insert mounted on the shell, the insert having a first stud protruding from the back side, the first stud having a nail-like head portion narrower than the receiving portion of the first keyhole mounting opening and wider than the slot portion of the first keyhole mounting opening, having a body portion between the head portion and the insert, and being positioned in the slot portion of the first keyhole mounting opening, the insert further having a second stud protruding from the back side and aligned with the second mounting opening, the second stud having a nail-like head portion narrower than the second mounting opening and a body portion, between the head portion and the insert, narrower than the head portion and positioned in the second mounting opening; and a movable fastening means for preventing withdrawal of the second stud through the second mounting opening.

9. A seat as recited in claim 8 further comprising: a back cover mounted on the seat and having an opening to provide access to move the fastening means.

10. A seat as recited in claim 9 wherein the fastening means comprises:

a restraining means rotationally connected to the shell, having a notched portion aligned to engage the body of the second stud thereby preventing withdrawal of the second stud through the second mounting opening, and having a securing portion for positively engaging a portion of the seat to prevent rotation of the restraining means.

11. A seat as recited in claim 10 further comprising:

a frame supporting and connected to the plastic shell, the frame having an opening for engaging and preventing rotation of the restraining means;

a protrusion from the restraining means for engaging the opening in the frame; and engaging means in the restraining means for receiving an instrument inserted through the opening of the back cover thereby providing for controlled rotation of the restraining means.

12. A seat as recited in claim 11 further comprising:

a frame protrusion extending from the frame adjacent the opening in the frame to engage the restraining means during rotation.

* * * * *